US005906123A

United States Patent [19]

Spurr

[11] Patent Number: 5,906,123

[45] Date of Patent: May 25, 1999

[54] VEHICLE DOOR LATCH ASSEMBLY

[75] Inventor: Nigel Spurr, Birmingham, United Kingdom

[73] Assignee: Meritor Light Vehicle Systems (UK) Ltd., Birmingham, United Kingdom

[21] Appl. No.: 09/051,437

[22] PCT Filed: Sep. 18, 1996

[86] PCT No.: PCT/GB96/02290

§ 371 Date: Jun. 8, 1998

§ 102(e) Date: Jun. 8, 1998

[87] PCT Pub. No.: WO97/15742

PCT Pub. Date: May 1, 1997

[30] Foreign Application Priority Data

Oct. 20, 1995 [GB] United Kingdom ..... 9521591

[51] Int. Cl.[6] ..... E05B 53/00

[52] U.S. Cl. ..... 70/264; 292/216; 292/DIG. 23

[58] Field of Search ..... 292/216, DIG. 23, 292/DIG. 65, 207, 203, 169.12, 169.14; 70/264

[56] References Cited

U.S. PATENT DOCUMENTS

| | | | |
|---|---|---|---|
| 4,073,519 | 2/1978 | Kurozu et al. | 292/216 |
| 4,455,042 | 6/1984 | Yamada | 292/216 |
| 4,921,286 | 5/1990 | Nakamura | 292/216 |
| 4,969,673 | 11/1990 | Portelli et al. | 292/216 |
| 5,054,827 | 10/1991 | Konchan et al. | 292/216 |
| 5,071,178 | 12/1991 | Brackman et al. | 292/216 |
| 5,277,461 | 1/1994 | Dzurko et al. | 292/216 |
| 5,308,128 | 5/1994 | Portelli et al. | 292/216 |
| 5,348,357 | 9/1994 | Konchan et al. | 292/216 |
| 5,454,608 | 10/1995 | Dzurko et al. | 292/216 |
| 5,531,488 | 7/1996 | Yoshikuwa et al. | 292/216 |
| 5,603,539 | 2/1997 | Gruhn et al. | 292/216 |
| 5,615,564 | 4/1997 | Inoue | 292/216 |
| 5,678,869 | 10/1997 | Yoshikuwa | 292/216 |
| 5,713,613 | 2/1998 | Honma et al. | 292/216 |
| 5,718,465 | 2/1998 | Dowling et al. | 292/216 |
| 5,735,557 | 4/1998 | Harvey | 292/207 |
| 5,785,366 | 7/1998 | Takaishi et al. | 292/216 |

FOREIGN PATENT DOCUMENTS

| | | |
|---|---|---|
| 2528098 | 12/1983 | France . |
| 23 40 301 A1 | 2/1975 | Germany . |
| 24 42 797 A1 | 3/1976 | Germany . |
| 1326871 | 8/1973 | United Kingdom . |
| 1340706 | 12/1973 | United Kingdom . |
| 1374902 | 11/1974 | United Kingdom . |

*Primary Examiner*—Steven Meyers
*Assistant Examiner*—Stephen Grady
*Attorney, Agent, or Firm*—Woodcock Washburn Kurtz Mackiewicz & Norris, LLP

[57] ABSTRACT

A passenger vehicle door latch assembly includes inhibiting means for preventing accidental setting of the latch to locked condition while the door is open. A resiliently loaded plunger is guided in fixed structure between a blocking position at which a head or other stop formation of the plunger prevents shifting of an element of a locking mechanism to its locked position and a free position at which locking can take place. The plunger co-acts with a face of a claw or other latch formation or with a face of a pawl or other retention element whenever the latter formation or element are not in their door securing relationship so preventing movement of the plunger from the blocking position until the door is closed.

4 Claims, 4 Drawing Sheets

VEHICLE DOOR LATCH ASSEMBLY

FIELD OF THE INVENTION

This invention relates to passenger vehicle door latch assemblies of the kind incorporating locking mechanism for selectively securing the latched door against unauthorized access.

BACKGROUND AND PRIOR ART

In order to reduce the likelihood of the vehicle keys becoming locked inside the vehicle it is common to provide at least one of the door latches on a vehicle with an inhibiting arrangement preventing the mechanism being set into the locked condition before latching has taken place i.e. while the door is open.

It is known from DE-A-2340301 to provide a latch assembly having a said inhibiting arrangement in which an inhibiting member linked to lock mechanism of the assembly is guided for movement between a blocking position at which it prevents shifting of said mechanism from unlocked to locked condition and a free position allowing said shifting to take place, said member being positioned to co-act with a relatively movable face of a latch formation of the assembly whereby the member abuts said face to prevent its displacement from the blocking position whenever that formation is not at a position at which it holds the associated door latched.

The object of the invention is to provide a latch assembly having locking mechanism with an inhibit arrangement which is simple, effective and reliable in operation; which is economical to manufacture and assemble; and which also functions in indexing or assisting the indexing of the locking mechanism so that it is more positively displaced and urged fully to its locked and unlocked conditions when not so inhibited.

SUMMARY OF THE INVENTION

According to the invention there is provided a passenger vehicle door latch assembly as defined by claim 1 of the appended claims.

BRIEF DESCRIPTION OF THE DRAWINGS

An example of the invention is now more particularly described with reference to the accompanying drawings, wherein.

DETAILED DESCRIPTION OF THE DRAWINGS

Figure 2:
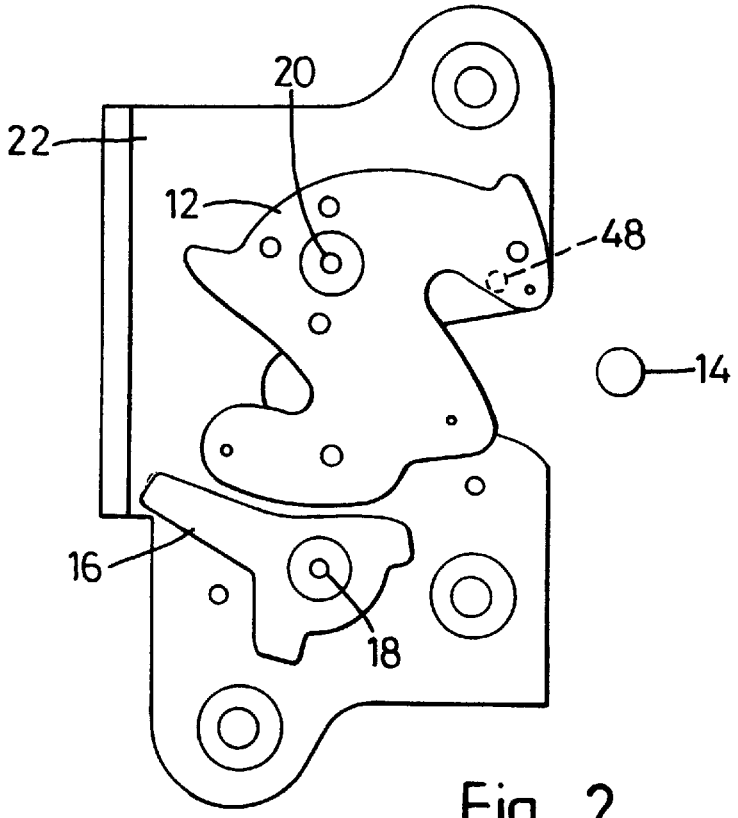
FIGS. 2 and 3 are views in the direction indicated at A—A on FIG. 1 showing a latch claw and pawl of said assembly at unlatched and latched positions respectively, FIGS. 4*a, b* and *c* are views of parts of said mechanism and a housing thereof in the direction indicated at B—B on FIG. 1 and showing three respective positions of components thereof, and FIGS. 5*a, b* and *c* are respective sections on lines C—C, D—D and E—E of FIGS. 4*a, b* and *c* respectively.
Figure 3:
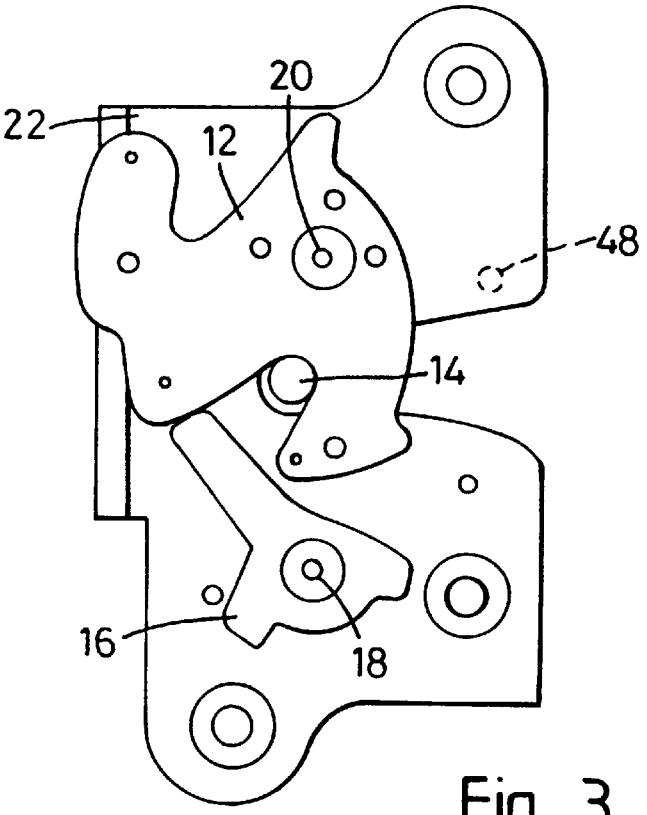

The latch assembly 10 for a passenger vehicle door comprises a latch formation in the form of a conventional rotatable claw 12 which co-acts in known manner with a striker 14 operatively mounted on the door post. A retention element in the form of a conventional springloaded pivoted pawl 16 retains the claw in engagement with the striker as seen in FIG. 3 to keep the door closed. When pawl 16 is released claw 12 can rotate anti-clockwise as seen in FIG. 3 to the FIG. 2 position, freeing striker 14 so that the door can swing open.

Claw 12 and pawl 16 are pivoted on respective pivot shafts 18, 20 secured to a metal back plate 22 operatively secured to the door and also forming part of an enclosure for the mechanism.

Figure 1:
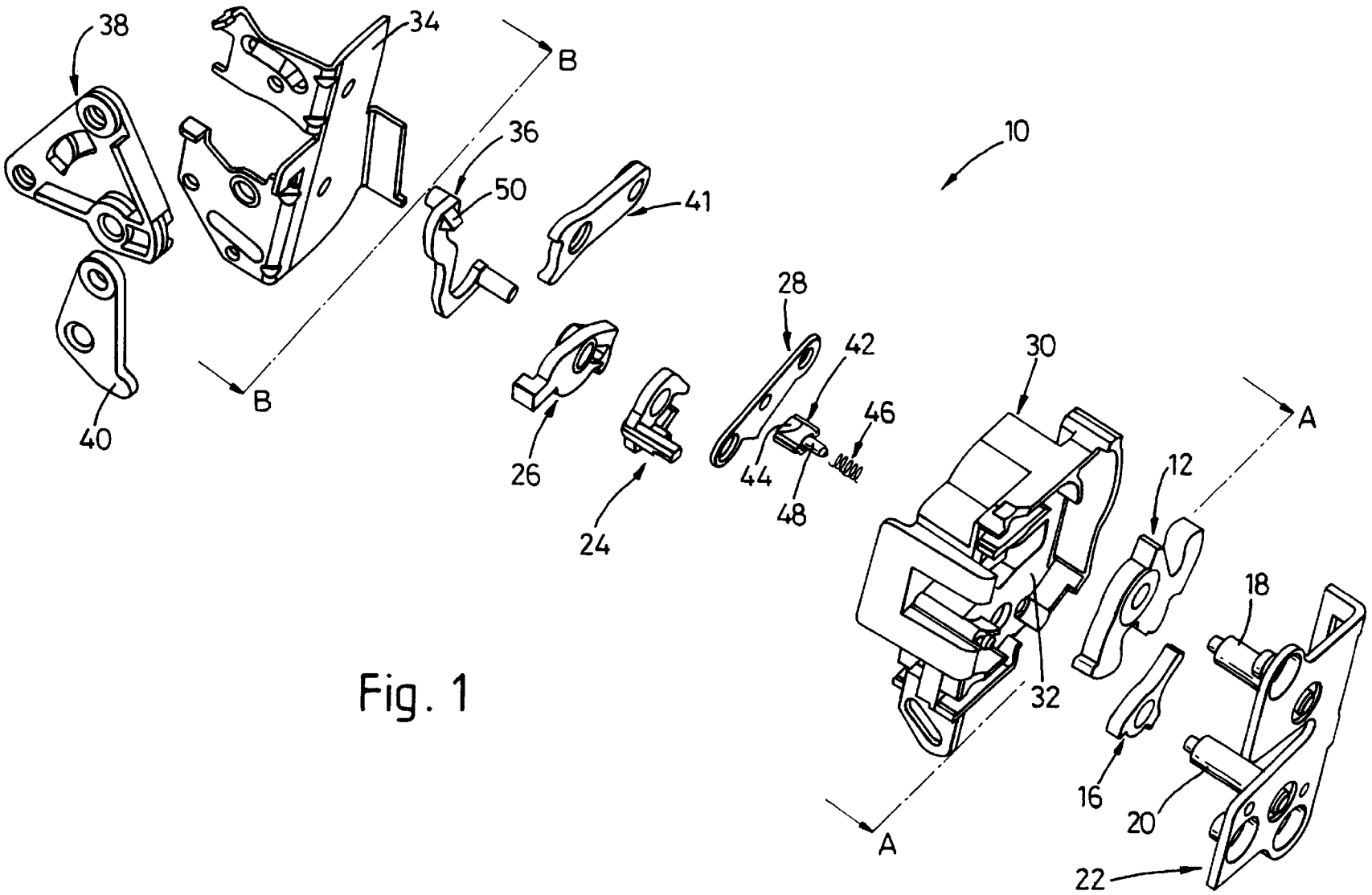
FIG. 1 is an exploded perspective view of a latch assembly and parts of associated locking mechanism.

Pawl 16 is selectively released for opening the door by a pawl lifter 24 (FIG. 1) which is in turn operated by release levers 26, 28 linked to the inside and outside door handles (not shown) in conventional manner. These levers and the locking mechanism of the assembly are located by and contained in a moulded plastics housing 30 having an inner wall or partition 32 which, together with back plate 22 defines an outer chamber containing claw 12 and pawl 16; and together with a cover plate 34 defines an inner chamber containing levers 26 and 28 and other parts of the mechanism.

To secure the door against unauthorized entry the locking mechanism includes a cranked release link 36 guided for generally vertical movement in its longitudinal direction between a locked condition at which it prevents movement of pawl lifter 24 so that pawl 16 cannot be freed from claw 12 once the door is closed, and an unlocked position at which lifter 24 can move pawl 16.

Release link 36 is shifted in turn by a locking lever 38 pivoted at right angles to the plane of link 36 on an arm of cover plate 34. Lever 38 is movable by means of an inside lock release lever 40, typically actuated by an interior sill button on the door, or by a conventional cylinder and tumbler key actuated lock or electrically coded lock on the door exterior (not shown) operating a key lever 41 and/or by an electric or other powered servo actuator, for example as part of a central locking system of the vehicle.

Such locking mechanism is generally of known type and will not be described further.

With mechanism arranged as so far described it would be possible to operate the locking mechanism while the door is open to set it to locked condition. If the door is then slammed shut, claw 12 will be rotated so that pawl 16 engages it, locking the door automatically without use of the key or code input device and with the consequent risk that the keys or device may be left locked inside the vehicle with no means of access.

This assembly further includes inhibiting means for preventing the mechanism being set to the locked condition before the door is closed. Said means comprises an inhibiting member in the form of a springloaded plunger 42 located and guided for longitudinal movement in a through bore in partition 32 of housing 30. A larger diameter head 44 of plunger 42 projects into said inner chamber and the plunger is resiliently urged in that direction by a compression spring 46 located on a lesser diameter stem 48 thereof.

Figure 5A:
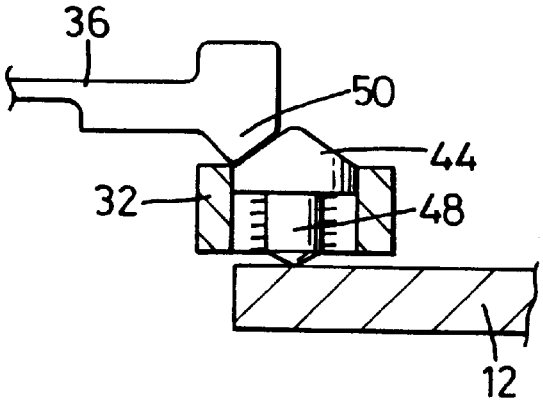
Figure 5B:
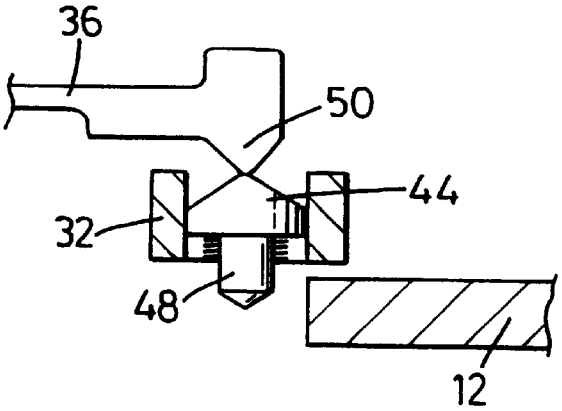
Figure 5C:
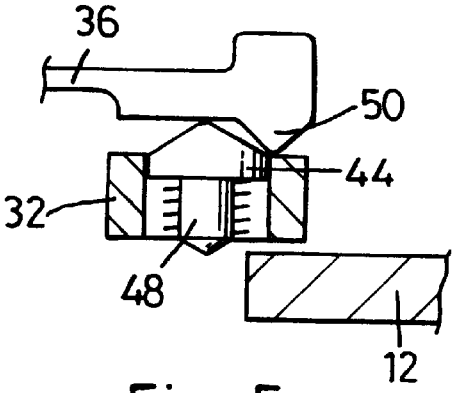

As best seen in FIGS. 5*a–c* head 44 has angled faces forming a chisel end which co-acts with a cam element 50 on a side face at the upper end of release link 36, that link moving in a plane parallel to one side of partition 32.

Figure 4A:
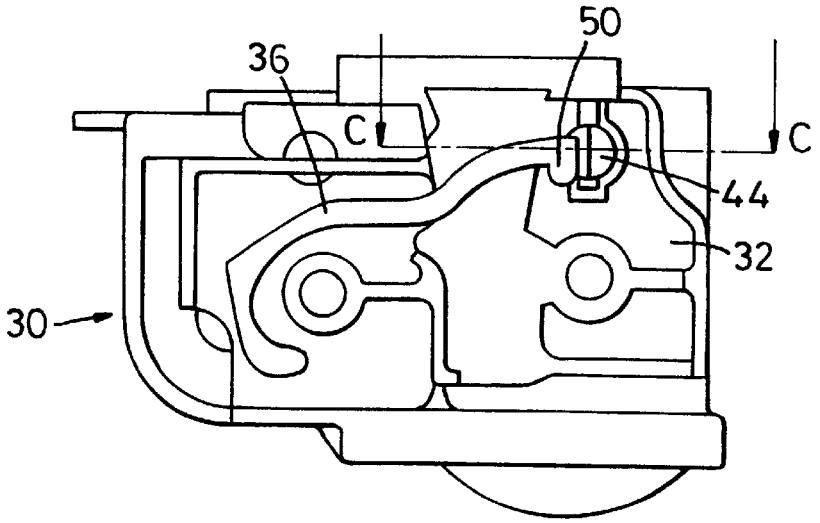
Figure 4B:
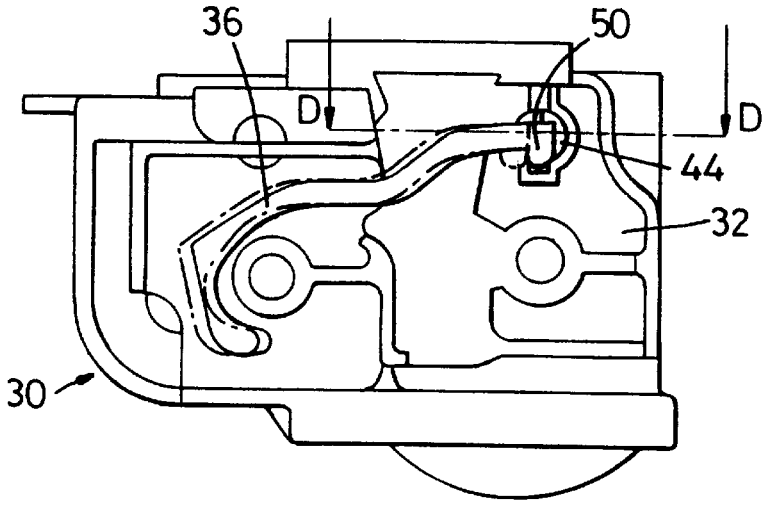
Figure 4C:
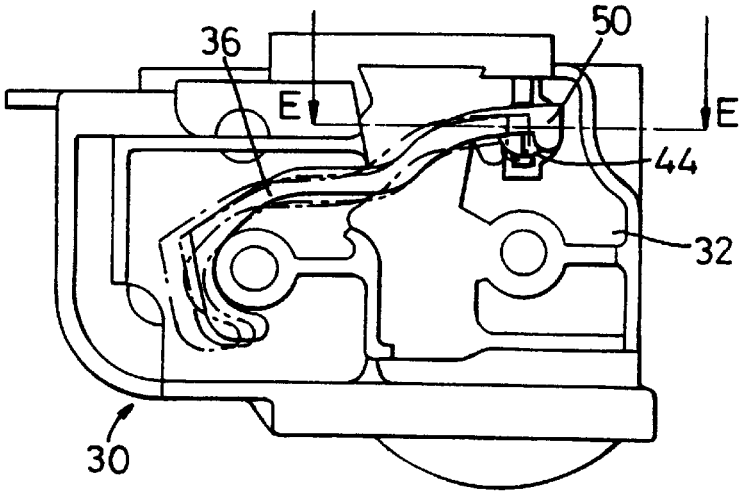

When plunger 42 is free to be depressed against spring 46 cam element 50 moves across head 44 from left to right as viewed in FIGS. 4 and 5 and in the sequence a, b, c, shown therein between unlocked condition (FIGS. 4*a* and 5*a*) and locked condition (FIGS. 4*c* and 5*c*). The camming action provided by the resiliently loaded plunger 42 assists in indexing link 36 positively to one or other of said positions and retaining it thereat when no locking or unlocking forces are applied.

As cam element 50 crosses the centre position (FIGS. 4*b* and 5*b*) it depresses plunger 42 so that the end of stem 48 remote from head 44 projects from the other side of partition 32 into the outer chamber.

When so projecting stem 48 intersects the path of movement of claw 12 in a plane parallel to the outer side of partition 32. The position of the plunger stem 48 is shown as a broken circle in FIGS. 2 and 3 and it will be seen that its relationship to claw 12 is such that it is clear of the claw when the door is fully closed (FIG. 3) so that the claw is engaged by pawl 16 but overlies the claw when the latter is rotated to the door open position (FIG. 2) not engaged by pawl 16. When claw 12 is at the latter position, indicated diagrammatically in FIG. 5*a* it blocks movement of plunger 42 against spring 46 as the end of stem 48 then abuts a side face of claw 12 and this prevents shifting of release link 36 from its unlocked position shown in FIGS. 4*a* and 5*a*. Therefore the mechanism can only be put from unlocked into locked condition after claw 12 has moved clear of plunger 42 as shown in FIGS. 5*b* and 5*c*.

The arrangement provides effective inhibition in a particularly simple manner and with a minimum of additional components, the simple plunger 42 avoids the need for more complex inhibiting levers and links and acts by direct coaction between claw 12 and release link 36, yet serves the dual function of inhibiting and indexing said link.

When the inhibit is operational link 36 is held against movement by the wedging action of head 44 against its camming formation rather than a dead stop so that there is less direct loading on the mechanism which might cause eventual failure. The resilient plunger type indexing gives a positive "feel " to the locking mechanism under manual operation making the user better aware that the required condition has been achieved.

It will be understood that alternative constructions are possible within the scope of the invention. For example the inhibiting means could take the form of a pivoted lever or link with appropriate resilient loading instead of a plunger. Furthermore the inhibiting member could be arranged to coact with some other part of the claw than its side face, for example can edge portion, or possibly with a part of pawl 16 instead of claw 12.

Similarly head 44 or equivalent part of the plunger or other inhibiting member could be arranged to coact with some other moving part or component of the locking mechanism instead of the release link 36.

I claim:

1. A passenger vehicle door latch assembly including a movable latch formation shaped to receive a co-acting striker in use on closing the associated door; a resiliently loaded retention element which releasably retains the latch formation against movement which would allow the door to open; release means operatively connected to a handle of the door for freeing the latch formation from the retention element when the door is to be opened; locking mechanism operable from the exterior of the vehicle by a key or other coded input to shift it between a locked condition preventing freeing of the latch formation from its closed condition and an unlocked condition in which said freeing by means of the door handle can take place; and inhibiting means preventing the locking mechanism being set to the locked condition if the latch formation is not positioned at a striker retaining position, said inhibiting means including an inhibiting member guided for movement between a blocking position at which a stop formation of said member co-acts with a part of a cam element of the locking mechanism to block shifting of said cam element from unlocked to locked condition and a free position permitting said shifting, said member being positioned to co-act with a relatively movable face of the latch formation or the retention element whereby the member abuts said face to prevent its displacement from said blocking position whenever the latch formation is not at a said retaining position, wherein said part of said cam element moves between the locked and unlocked conditions in a path normal to the path of said movement of the inhibiting member and into and away from abutment with the stop formation, with the inhibiting member being resiliently biased towards the blocking position independently of the locking mechanism, and said part and said formation abutting each other with a camming action displacing said member against the biasing when it is otherwise free for movement.

2. An assembly as in claim 1 wherein said camming action assists in the positive indexing of said cam element to the condition selected.

3. An assembly as in claim 1 wherein the inhibiting member is a spring-loaded plunger guided for rectilinear movement by a through bore on fixed structure of the assembly to act between said cam element moving in a first plane parallel to one side of said structure and said face of the latch formation or retention element moving in a second plane parallel to said first plane on the other side of said structure.

4. An assembly as in claim 2 wherein the inhibiting member is a spring-loaded plunger guided for rectilinear movement by a through bore on fixed structure of the assembly to act between said cam element moving in a first plane parallel to one side of said structure and said face of the latch formation or retention element moving in a second plane parallel to said first plane on the other side of said structure.

* * * * *